United States Patent [19]

Hillis et al.

[11] Patent Number: 4,655,532

[45] Date of Patent: Apr. 7, 1987

[54] CIRCUMFERENTIAL GROUNDING AND SHIELDING RING FOR AN ELECTRICAL CONNECTOR

[75] Inventors: Frank M. Hillis, Franklin; Robert W. Brush, Sr., Unadilla, both of N.Y.

[73] Assignee: Allied Corporation, Morristown, N.J.

[21] Appl. No.: 826,534

[22] Filed: Feb. 6, 1986

[51] Int. Cl.[4] ..... H01R 13/648

[52] U.S. Cl. ..... 339/143 R; 339/14 R

[58] Field of Search ..... 339/14 R, 143 R

[56] References Cited

U.S. PATENT DOCUMENTS

| | | | |
|---|---|---|---|
| 4,239,318 | 12/1980 | Schwarz | 339/143 R |
| 4,326,768 | 4/1982 | Punako | 339/143 R |
| 4,423,919 | 1/1984 | Hillis | 339/143 R |
| 4,428,639 | 1/1984 | Hillis | 339/143 R |
| 4,470,657 | 9/1984 | Deacon | 339/143 R |
| 4,512,623 | 4/1985 | Tomsa | 339/143 R |

FOREIGN PATENT DOCUMENTS

| | | | |
|---|---|---|---|
| 0091370 | 10/1983 | European Pat. Off. | 339/143 R |
| 2073503 | 10/1981 | United Kingdom | 339/143 R |
| 2127626 | 4/1984 | United Kingdom | 339/143 R |

*Primary Examiner*—Eugene F. Desmond

*Attorney, Agent, or Firm*—C. D. Lacina

[57] ABSTRACT

A shielding and grounding ring comprises a cup shaped member including a flat ring portion defining the base of the cup and having a central opening sized to fit about a plug shell, a skirt described by a plurality of slots and associated fingers each extending longitudinally from the end of the skirt to locations on the ring portion, and a circumferential lip extending rearwardly from the opening. When a compression ring is plastically deformed in the groove, the lip and the ring portion, respectively, make substantially 360° contact with the annular groove and the radial flange thereby providing positive retention and completing electrical circuit paths with the plug shell. The slots undergo a 90° change in direction to reduce adverse stress which could lead to spring finger failures in the ring.

5 Claims, 5 Drawing Figures

FIG.3
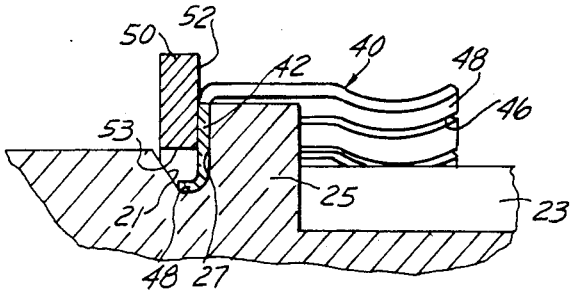
FIG.4
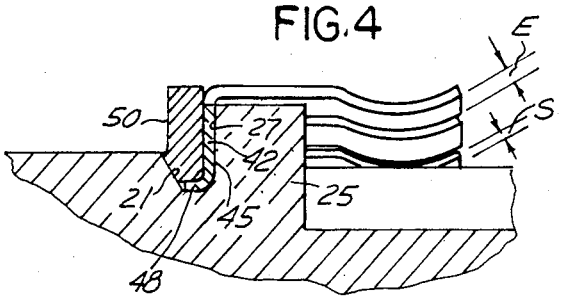
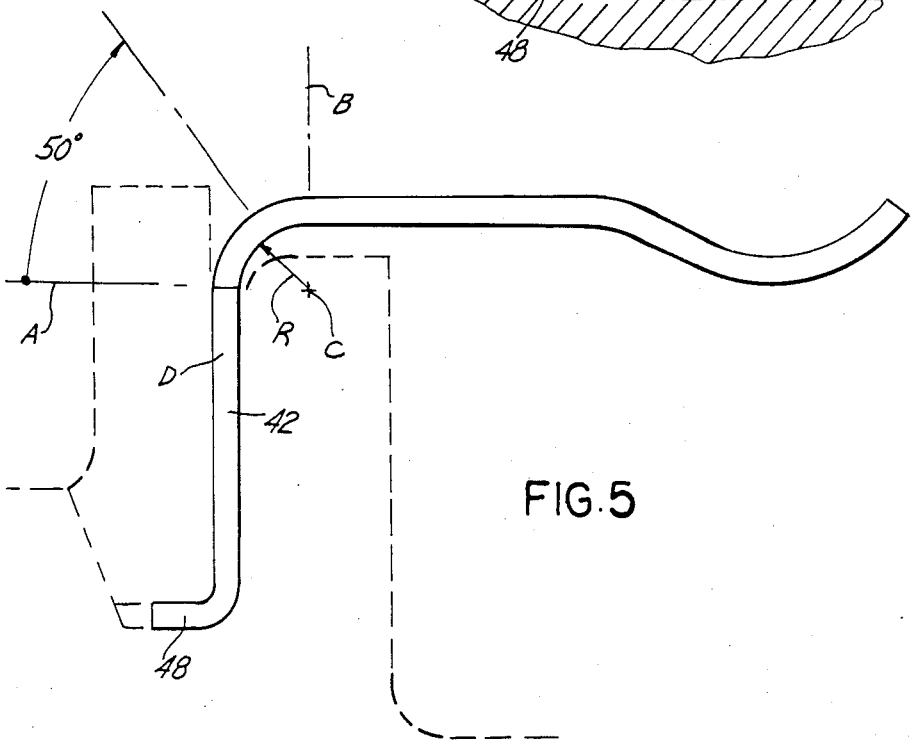
FIG.5

CIRCUMFERENTIAL GROUNDING AND SHIELDING RING FOR AN ELECTRICAL CONNECTOR

This invention relates to a circumferential grounding and shielding ring for an electrical connector assembly and, more particularly, to a connector assembly having an improved solderless arrangement for mounting the shielding ring about a connector shell.

A grounding and shielding ring for connector shells is typically cup-shaped and mounted on a plug shell with deflectable spring fingers from the shielding ring being adapted to be biased against the outer periphery of a mating receptacle shell. For ease of assembly the ring is integrally stamped from a metal sheet and formed by rolling the edges of the sheet into the cup-shape. U.S. Pat. Nos. 4,423,919 and 4,428,639 disclose solderless approaches for mounting a grounding ring to a connector shell. While many solderless mounting arrangements perform well in some environments, other approaches provide a grounding ring mounting which is too sensitive to tolerance variations in order to be dependable. A split ground ring requires attention to the bias force of the spring fingers. A loosely fitted ground ring will increase shell-to-shell resistance. In some configurations it has been found that when the plug assembly mates with the receptacle assembly, the spring fingers deflect radially in relation to the connector axis and impose a stress at the bottom of the slots. This can result in cracks in the grounding ring and thereby result in adverse shell-to-shell resistance, and reduce spring finger forces which could break down oxides which form and resist good electrical circuit relation being established. Further, once a crack develops, the stopping point of the crack cannot be stopped. As a result and during vibration, it has been found that a complete break can occur in an already split grounding ring, and the separated ring portions can be driven radially outward from their mounting in an annular groove around the plug shell.

Accordingly, it would be desirable to have a shielding and grounding device which does not crack, maintains strong spring forces for establishing low shell-to-shell resistance values, and does not break free from its mounting about the shell to which it is mounted.

In furtherance of this, an electrical connector includes a pair of mating electrical connector members having telescopically assembled conductive shells to provide overlapping adjacent circumferential surfaces with one of the surfaces being provided with a continuous circumferential groove of predetermined axial dimension. A shielding and grounding ring is mounted in the groove, the ring comprising a flat ring portion extending substantially continuously around the annular groove and having an inner and an outer edge with the inner edge being disposed in the groove. A set of radially deflectable spring fingers are integral with the outer edge each extending longitudinally therefrom along the connector axis and terminating in a deflectable free end portion adapted to engage the other of the surfaces. The fingers are angularly spaced whereby to describe a set of axially extending slots The shielding and grounding ring is characterized by a circumferential lip extending axially from the inner edge and in electrical circuit contact relation substantially continuously 360° around and within the groove and the slots defining each finger undergoing approximately 90° change in direction so as to extend into the ring portion. The mounting means includes a compression ring being plastically deformed to press the circumferential lip radially inward against the circumferential surface of the annular groove and the ring portion axially forward and against a rearwardly facing axial wall defined by the groove.

FIG. 3 is a partial cross-section view of the shielding ring and a compression ring about to be mounted to the connector shell.

FIG. 4 is a partial cross-section view of the shielding and compression rings mounted to the connector shell.

FIG. 5 is an enlarged view of the shielding and grounding ring.

FIG. 6 shows the connector shell and compression ring in phantom and detail of the shielding ring relative thereto.

Figure 1:
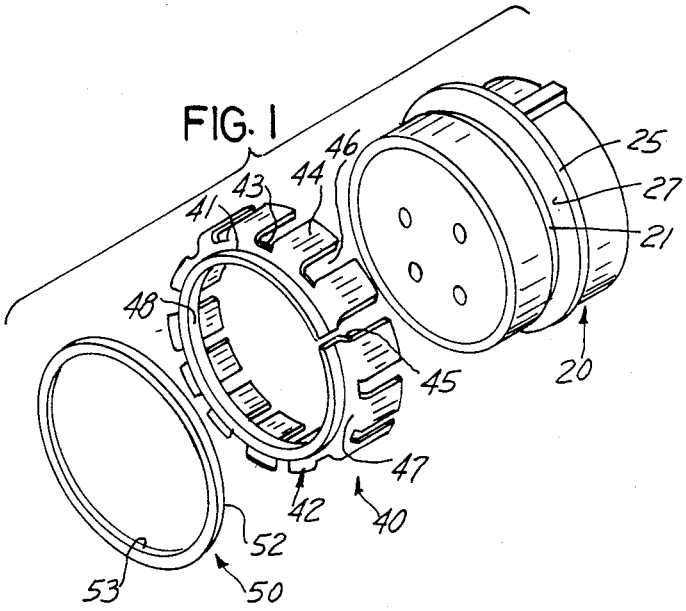
FIG. 1 is a side view partially in section of a grounding and shielding ring in an electrical connector assembly.

Turning now to the drawings, FIG. 1 shows a partial sectional view of a receptacle and a plug electrical connector subassembly 10,20 about to be mated. Each of the connector subassemblies are generally comprised of a cylindrical shell 12,22 of conductive material with a forward portion 24 of the plug shell 22 being sized to telescopically interfit within a forward portion 14 of the receptacle shell 12 such that when mated respective outer surfaces are overlapping. When mated, the end face of the receptacle makes abutting contact with a moisture seal (not shown) extending around the plug shell. The connector subassemblies have electrical contacts which engage upon axial mating of the connector shells along a center axis thereof. Typically a plurality of socket-type contacts 26 are positioned in the plug shell for mating engagement with a like plurality of pin-type contacts 16 in the receptacle shell, each of the contacts being positioned in dielectric insulators mounted within the respective shells. A coupling nut 30 is captivated for rotation on the plug shell such that a helical groove 32 on in inner wall of the nut threadably engages with a bayonet pin 34 on the outer surface of the receptacle shell. A keyway 13 in the receptacle shell 12 receives a polarizing rib 23 on the plug shell to prevent relative rotation between the connector shells when the coupling nut 30 rotates to draw the shells axially together along the central axis.

A cup-shaped grounding and shielding ring 40 is mounted onto the plug shell in a continuous annular groove 21 adjacent to a radial flange 25. A compression ring 50 is plastically deformed into the annular groove to non-removably retain the shielding ring.

Figure 2:
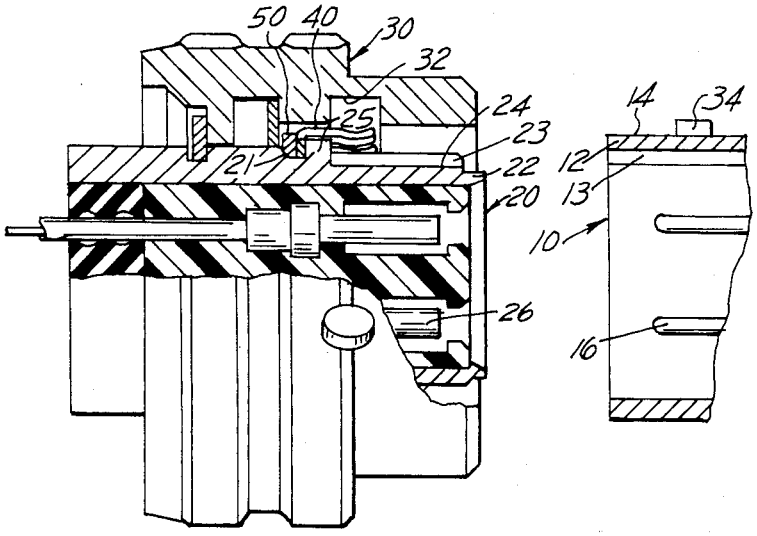
FIG. 2 is an exploded perspective view of the shielding ring about to be assembled to a connector shell.

FIG. 2 shows detail of the two rings. The shield ring 40 is cup-shaped, split, has a slotted skirt, and is integrally formed of a conductive material whereby to ground the mated assembly of connector shells. The ring 40 comprises a flat annular ring portion 42 having forward and rearward faces 45,47, an inner edge 41 and an outer edge 43, and a plurality of resilient, convexly-curved, spring fingers 44 each extending from the outer edge and integrally formed therewith. The inner edge defines an opening (i.e., has an inner diameter) sized to allow the ring portion to be slidably clearance fit over the rearward end portion of the plug shell. Extending axially rearward from the inner edge of the ring portion is a continuous circumferential lip (i.e., annular flange)

48 having an axial dimension sized to fit the annular groove 21.

Each of the fingers 44 are defined by a longitudinally extending slot 46, the slot undergoing a 90° change in direction so as to terminate radially inward from the locus of finger inner surfaces and be within the ring portion.

The compression ring 50 is not split and is assembled over the rearward end portion of the plug shell. The compression ring is comprised of an electrically conductive material and is mounted to the plug shell so that a forward ring face 52 thereof will uniformly butt against the rearward face 47 of the flat ring portion 42, and an inner circumferential face 53 thereof (i.e., the opening) is circumposed around the annular groove. The compression ring is made of electrically conductive material since the compression ring is included in the ground path of the shielded connector. The higher the electrical conductivity of the material used to form the compression ring the better. For details, the reader is refered to U.S. Pat. No. 4,428,639, incorporated herein by reference.

FIG. 3 shows the shielding and grounding ring 40 disposed in the annular groove 21 of the plug shell 22 with the forward face 45 of ring portion 42 abutting the rearward face 27 of radial flange 25. Lip 48 substantially circumferentially closes about the circumferential surface forming the annular groove 21. The slots 46 in the configuration shown are disposed substantially at or radially inward from the top circumferential face of the radial flange. The compression ring 50 is positioned for inward radial compression into the annular groove and about the circumferential lip 48.

FIG. 4 shows the assembled relation of the shielding and grounding ring 40 and the compression ring 50 in the annular groove 21. The grounding ring is such that the forward face 45 and the circumferential lip 48 are in substantial 360° abutment with the rearward face 27 and circumferential periphery of annular groove 21. The compression ring assures positive retention of the grounding ring as a result of engagement with the lip 48 and good electrical circuit path characteristics by the 360° engagement with the plug shell.

FIG. 5 shows an enlarged view of the shielding and grounding ring 40 mounted within the annular groove. The spring fingers 44 extend longitudinally from the outer edge of the ring portion 42 from which they are integrally connected and the slots 46 undergo approximately a 90° change in direction to terminate in respective roots on the ring portion. The ring portion has its forward face in firm fitting relation about the rearward face of the radial flange and the circumferential lip 48 in firm fitting relation substantially 360° about the base of the annular groove.

It is believed that the fingers terminations preferably should be formed by a generous, generally circular radius as shown by the position "C". The smaller the bend radius the more likely it is believed that cracks will form. Further, it is believed that a slot 46 should preferably terminate in the ring portion 42 after having undergone a 90° change in direction and lie in a plane which is concentric with and passes through the position "C". As the slot terminus (preferably defined by an imaginary radius line "A") is moved from ring portion 42 and positioned closer to the spring fingers (such as defined by an imaginary radius line "B") the more likely it is that cracks will form in the spring fingers. Preferably, the slots 46 should not terminate at a position greater than 50° from radius "A". Further, the slots 46 should not terminate at ring portion locations on the ring portion downwardly from the radius line "A" (e.g., such as shown by point "D") since it is believed that this location would tend to adversely weaken spring finger forces.

The spring fingers should, preferably, have an angular extension "E" (see FIGS. 3 and 4) much greater than the angular separation "S" defined by the slots 46.

We claim:

1. An electrical connector comprising a pair of mating electrical members having telescopically assembled conductive shells providing adjacent circumferential surfaces, a continuous groove of predetermined axial dimension in one of said surfaces, a shielding and grounding device mounted in said groove, and retaining means disposed in said groove for non-removeably retaining said shielding device in said groove, said shielding device comprising a ring portion extending substantially continuously around said groove and having an inner and outer edge with the inner edge thereof being disposed in said groove, and a set of fingers being integrally formed with the outer edge thereof and extending axially forward therefrom to deflectable free end portions, the fingers being angularly spaced whereby to describe a set of axial slots and said free end portions of said fingers being adapted to engage the other of said surfaces upon mating, and further characterized by said device having a lip extending axially from said ring portion so as to be in contact with said groove and each said slot undergoing approximately a 90° change in direction so as to terminate in the ring portion, and said retaining means pressing the lip radially inward and into contact with the circumferential periphery of said groove and the ring portion axially forward and against a rearwardly facing axial wall defined by the groove.

2. The invention as recited in claim 1 wherein the lip forms a substantially continuous 360° electrical seal with the annular groove and extends in a direction rearwardly from the direction of said fingers.

3. A combination shielding and grounding device formed from resilient conductive sheet metal for installation in an annular groove of predetermined axial dimension within overlapping conductive shell portions of a pair of mating electrical connector subassemblies, comprising a ring portion adapted to extend substantially continuously about the circumference of said groove and including opposite edges, a set of spaced fingers integral with one of said edges of said ring portion each extending in first direction generally coplanar with the ring portion and then in a second direction generally perpendicular to the ring portion, said fingers being defined by a corresponding set of slots each terminating within the ring portion, and a lip integral with the other of said edges and extending perpendicularly therefrom.

4. The invention according to claim 3 wherein said lip extends in a direction opposite to that of said fingers and forms a substantially continuous 360° surface for gripping closure about and around said groove, the extension of said flange and the thickness of said ring portion defining an axial dimension less than the predetermined axial dimension.

5. The invention according to claim 3 wherein each said finger subtends an angular width substantially greater than the angular separation defining the slot between its adjacent fingers.

* * * * *